United States Patent [19]

Pugh et al.

[11] 4,415,830

[45] Nov. 15, 1983

[54] INLEAD CONSTRUCTION FOR ELECTRIC LAMP

[75] Inventors: John W. Pugh, Gates Mills; Francis W. Pikus, Cleveland Heights; James A. Graves, Highland Heights; John E. McMillan, Kirtland, all of Ohio; John L. Walter, Scotia, N.Y.

[73] Assignee: General Electric Company, Schenectady, N.Y.

[21] Appl. No.: 298,073

[22] Filed: Aug. 31, 1981

[51] Int. Cl.[3] ..... H01J 5/50

[52] U.S. Cl. ..... 313/331; 148/111; 313/49; 313/318

[58] Field of Search ..... 313/49, 318, 331; 148/111

[56] References Cited

U.S. PATENT DOCUMENTS

| | | | |
|---|---|---|---|
| 1,547,394 | 7/1925 | Hoyt . | |
| 2,206,937 | 7/1940 | Briggs | 313/331 |
| 2,329,343 | 9/1943 | English | 313/331 |
| 2,333,622 | 11/1943 | McNab | 313/331 |
| 2,484,311 | 10/1949 | Prakke et al. | 313/331 |
| 4,113,529 | 9/1978 | Fiedler | 148/111 |
| 4,174,235 | 11/1979 | Fiedler | 148/111 |
| 4,208,603 | 6/1980 | Graves | 313/332 |

*Primary Examiner*—Harold Dixon

*Attorney, Agent, or Firm*—John F. McDevitt; Philip L. Schlamp; Fred Jacob

[57] ABSTRACT

An improved inlead construction for an electric lamp is disclosed which utilizes an iron alloy containing sufficient silicon to avoid transformation of the inlead from the alpha ferrite phase to the gamma austenite phase at lamp operation temperatures. This precludes debilitating deformation of the inlead wires caused by on-off cycling of the lamp and concomitant cycling of the wire through the alpha to gamma transformation range. Such deformation can lead to structural or operational failure if the inleads become disconnected or electrically shorted from the resistive filament during lamp operation. In a preferred lamp construction, a pair of the improved inlead wires serve as the sole means of physical support for a resistive incandescent filament directly connected thereto and said inlead wires can further be coated with a dissimilar metal for higher lamp loading requirements in order to help avoid iron migration which can produce deterioration of the resistive incandescent filament.

10 Claims, 2 Drawing Figures

INLEAD CONSTRUCTION FOR ELECTRIC LAMP

BACKGROUND OF THE INVENTION

There is disclosed in U.S. Pat. No. 4,208,603, which is assigned to assignee of the present invention, the use of dispersion-strengthened copper alloy serving as the sole means of physical support for a resistive incandescent filament in various type electric lamps. Nickel plating of the inlead wires is also disclosed as a means of reducing contaminant release from an underlying copper sheath during manufacture of the lamp devices. The stiffness values required to provide adequate physical support of the resistive incandescent filament are said to reside within a range of approximately 300–500 as measured by the particular method described in a further referenced U.S. Pat. No. 4,131,819 patent. The preferred incandescent lamp embodiments illustrated in said U.S. Pat. No. 4,208,603 employ a filament mount construction providing hermetic sealing of a central dumet portion of the inlead members to the lamp glass envelope. In one of said lamp embodiments the resistive incandescent filament being supported by the inlead members alone is aligned in a transverse direction with respect to the longitudinal direction of said inlead wires and which is customarily termed a CC6 mount orientation of said filament. A different filament orientation is also disclosed wherein the longitudinal direction of said filament is aligned in the same direction as the longitudinal direction of the inlead wires and with said arrangement being termed a CC8 mount construction.

Various metal alloys have also been employed as the inlead material in electric lamps including iron alloys. For example nickel-iron alloys clad with copper are disclosed in U.S. Pat. No. 1,547,394, also assigned to the present assignee, as providing a direct hermetic seal to the glass envelopes used for incandescent lamps, vacuum tubes and other electrical devices. Copper and tin plated steel have also been employed heretofor as an electrical conduction element such as, connectors and the like. Iron alloys containing silicon are also now commonly employed for their magnetic characteristics in still other type electrical devices. In U.S. Pat. No. 4,113,529 and 4,174,325, also issued to the present assignee, there is disclosed a silicon iron alloy containing from approximately 2.5–4.5 weight percent silicon together with various small amounts of carbon and various other impurities exhibiting the desired magnetic characteristics to be employed as "electrical" steel in motors, transformers, and the like. A ternary iron alloy containing boron and silicon is also disclosed in U.S. Pat. No. 4,217,135 as exhibiting the desired magnetization for superior performance in the latter type electrical devices. The electrical resistance in these alloys is increased by silicon addition which desirably decreases eddy current losses when such type electrical devices are operated.

SUMMARY OF THE INVENTION

This invention is based on the discovery that an iron alloy containing sufficient silicon to avoid allotropic transformation of the alpha ferrite crystalline phase to the gamma austenite crystalline phase at lamp operating temperatures can be used to advantage for the inlead material in various type of electric lamps. Such general use for said inlead material can permit the resistive filament in an incandescent lamp to be connected directly thereto without deforming as a consequence of on-off cycling of the lamp and to further include filament mount constructions wherein the inlead wires serve as a sole means of physical support for said resistive incandescent filament. In a different lamp embodiment, said inlead material serves equally well to replace the more expensive nickel iron or titanium metals now employed as a structural support in commercial high pressure sodium vapor lamps. The specific operational problem ameliorated in accordance with the present invention occurs when the inlead members open, distort or deform as the lamp is cycled repeatedly. A principal cause of said problems is the progressive response to prolonged cycling through transformation of the iron inlead material from the alpha ferrite phase to the gamma austenite phase and back to said alpha ferrite phase. While an electric lamp being continuously operated might not experience failure due to this problem, most lamp installations encounter frequent cycling during ordinary operation.

Suitable iron alloys for the aforementioned lamp applications comprise iron rich metals including otherwise pure iron and steel which further contain slightly more than from about 2 weight percent silicon content up to approximately 4.5 weight percent silicon and which may also contain amounts of still other alloy and elements such as carbon, aluminium, chromium, and others, in sufficient amount to avoid the above defined allotropic transformation. Approximately 2.15 weight percent silicon is required to completely supress said undesired phase transformation at lamp operating temperatures in iron alloys devoid of carbon. Accordingly pure iron or steels containing very low carbon (less than about 0.02 weight percent) can avoid any significant allotropic transformation to the gamma austenite crystalline phase provided the silicon content of these iron alloys is at the 2.15 weight percent level or greater. If the carbon content in a steel alloy is in the 0.01–0.02 weight percent range, however, then approximately 2.5 weight percent silicon will be required to completely avoid the undesired transformation. Moreover, carbon levels in steel alloys at the approximate 0.05 to 0.08 weight percent range should not be employed due to some formation of the gamma austenite phase at lamp operating temperatures regardless of the silicon levels. The aforementioned upper level for silicon content in the present inlead material is dictated by practical considerations associated with forming the alloy into suitable inlead shapes. For example, conventional size inlead wires having any higher silicon content have been found too stiff and brittle during lamp manufacture for reliable clamping to each end of the customary resistive filaments used in incandescent lamps.

Copper coating of the present inlead constructions such as by plating can help prevent iron contamination in certain lamp embodiments operating at relatively high temperatures. More specifically, it has been found that iron migrates from the present inlead wires connecting the resistive filament in incandescent lamps that are operated under higher electrical loading conditions. A coating of these inlead wires with copper or some other dissimilar metal such as tungsten or molybdenum can thereafter prevent contamination of the resistive incandescent coil which leads to its embrittlement as well as desirably increase electrical conductivity and avoid rust formation during lamp manufacture.

DETAILED DESCRIPTION OF THE PRESENT INVENTION

Figure 1:
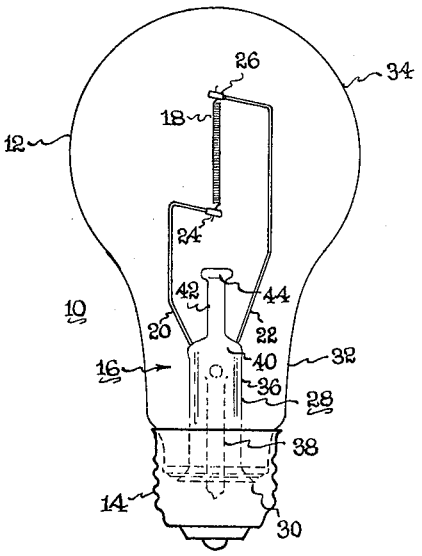
FIG. 1 depicts a cross-section one preferred incandescent lamp embodiment of the present invention.

Referring to FIG. 1, there is shown in cross-section an otherwise conventional incandescent lamp 10 having a transparent envelope 12 which is secured to a base member 14 to provide a housing assembly for a mount construction 16 modified in accordance with the present invention which supports the resistive incandescent filament 18 serving as the illumination source in said lamp. An inert gas or vacuum (not shown) is further provided within the sealed transparent envelope, conventionally made of glass, to protect against filament oxidation during lamp operation and the filament material is generally tungsten or some other suitable refractory metal, including alloys thereof. For the purpose of this invention, the term "transparent" being used to characterize the lamp envelope signifies the ability to transmit visible light and conventional incandescent lamps include coloration of the envelope material itself as well as coating the lamp envelope with a material which diffuses or reflects light. The modified mount construction 16 being depicted provides longitudinal alignment of said filament coil 18 in the same direction as the longitudinal direction of a pair of in lead wires 20 and 22 that are connected to each end 24 and 26, respectively, of the filament coil. A central glass member 28 in the depicted mount construction is provided having a flare portion 30 which is sealed directly to a restricted neck portion 32 of the lamp glass envelope 12 at the base of a bulb portion 34 in said envelope. Said glass body member 28 is in the form of a hollow tube 36 which includes an inner glass exhaust tube 38 and with said glass body member further including a stem press 40 at the opposite end of said member having flare portion 30 to provide hermetic sealing of the inlead wires 20 and 22 in said lamp. As can be noted by an absence from said drawing, no other conventional tie wires or support wires are provided to physically support the lamp coil in said modified mount construction so that said pair or iron alloy inlead wires formed in accordance with the present invention provide the sole structural support for said lamp coil. Accordingly, it will also be apparent that the glass extension 42 and button 44 in said glass body member 28 have now become superfluous, as filament support means, hence could be eliminated for greater simplification of the mount construction now being used.

Figure 2:
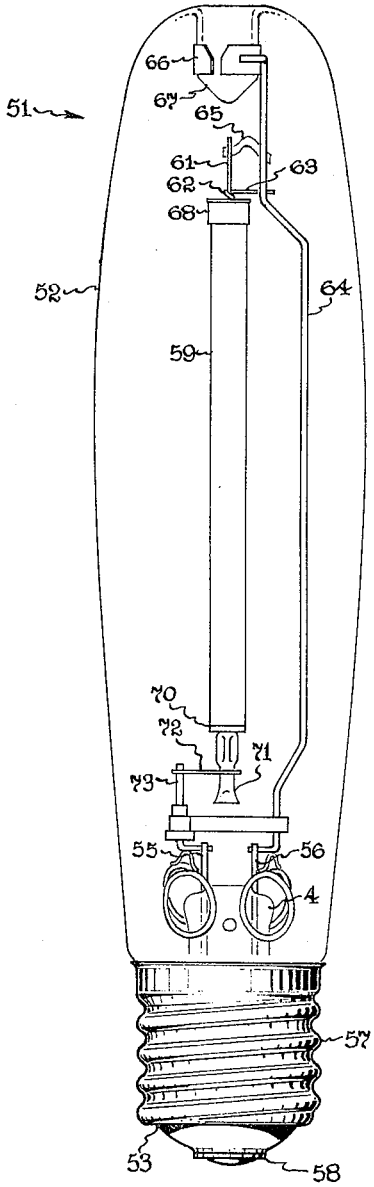
FIG. 2 depicts in cross-section a high pressure sodium vapor lamp being made in accordance with the present invention.

Referring to FIG. 2, an otherwise conventional prior art high pressure sodium vapor lamp is depicted in cross-section, which can have the same general structural configuration described in U.S. Pat. No. 4,065,691, also assigned to the present assignee. In said high pressure sodium vapor lamp 51 embodying the present invention, and corresponding to a 400 watt size, there is included a vitreous outer envelope 52 with a standard mogul screw base 53 attached to one end and comprising a reentrant stem press 4 through which extends, in conventional fashion, a pair of relatively heavy lead-in conductors, 55 and 56, whose outer ends are connected to the screw shell 57 and eyelet 58 of the base. The inner envelope or arc tube 59, centrally located within the outer envelope, comprises a length of light-transmitting ceramic tubing, suitably polycrystalline alumina ceramic which is translucent, or single crystal alumina which is clear and transparent. The upper end of the arc tube is closed by an alumina ceramic plug through which extends a niobium inlead wire 61 which is hermetically sealed and which supports the upper electrode. The external portion of inlead 61 passes through a loop 62 in transverse support wire 63 attached to a side rod member 64. This arrangement allows for thermal expansion of the arc tube during operation when the lower end seal is rigidly fixed in place, and a resilient metal ribbon 65 assures a good electrical connection. Side rod member 64 is welded to lead-in conductor 56 and has its upper end braced by spring clamp 66 which engages inverted nipple 67 in the domed end of the outer envelope. A metal reflective band 68 may desirably extend around the upper end of the arc tube in order to maintain the desired temperature at the upper end seal particularly in smaller sizes of lamps such as 250 watts or less. The lower end closure and electrode support assembly in said lamp comprises a shouldered alumina ceramic plug 70 having a central aperture through which extends a thin walled niobium tube 71 to serve as an exhaust tube and as an inlead. The tube extends but a short distance through the plug and is hermetically sealed therethrough with a ceramic sealing composition (not shown). The arc tube is supported in the outer envelope by a connector 72 which is welded across from tubular inlead 71 to a support rod 73 joined to a lead-in conductor 55. The further conventional discharge electrodes disposed at each end of said arc tube need not be further described as forming no part of the present invention.

In connection with said FIG. 2 lamp embodiment, the present invention resides in replacing the conventional nickel-iron or titanium metal used to form the side rod member 64 with the present silicon iron alloys. It can be noted from said drawing that extensive mechanical forming of said side rod member is required to provide the final shape used in this lamp construction. The present alloy has been discovered to exhibit a considerably lower tensile strength as compared with the conventional nickel iron alloys commonly employed which provides a distinct advantage in the lamp manufacture. For example, the 52 weight percent nickel containing iron alloy now in use exhibits an ultimate tensile strength in the range 120,000–150,000 pounds per square inch whereas a comparable value of approximately 83,000 pounds per square inch has been found in the preferred silicon iron alloys above disclosed.

It will be apparent in the foregoing description, that various modifications may be made within the spirit and scope of the present invention. For example, other lamp configurations than above specifically disclosed can benefit by utilization of the present improved inlead construction as a substitute for dispersion strengthened alloys and still other alloys inlead materials now in use. It will also be evident that modifications in the present inlead constructions ae contemplated such as the coating of inlead wires with a dissimilar metal, for example, copper or niobium or chromium in order to provide further benefits in the lamp embodiment as above above disclosed. One skilled in this lamp art will further recognize that compound or composite inlead constructions are contemplated having an inner portion formed with the present inlead material which can be joined in conventional fashion to dumet metal for hermetic sealing in the lamp glass envelope. Moreover, the substitution of aluminum for silicon in the present iron alloys is also expected to avoid the undesired crystalline phase transformation at lamp operating temperatures. It is intended to limit the present invention, therefore, only the scope of the following claims.

What we claim as new and desire to secure by United States Letters Patent is:

1. An inlead material for an electric lamp which comprises an iron alloy containing silicon in an amount from slightly more than about 2 weight percent up to about 4.5 weight percent to avoid allotropic transformation to the gamma austenite phase at lamp operating temperatures.

2. An inlead material as in claim 1 which contains at least about 2.5 weight precent silicon.

3. An inlead material as in claim 1 which contains at least about 2.15 weight percent silicon and no more than about 0.02 weight percent carbon.

4. An electric lamp having a transparent envelope which contains a resistive incandescent filament electrically connected to a pair of conductive inlead wires, said inlead wires comprising an iron alloy containing silicon in an amount from slightly more than about 2 weight percent up to about 4.5 weight percent to avoid allotropic transformation to the gamma austenite phase at lamp operating temperatures.

5. An electric lamp as in claim 4 wherein said inlead wires serve as the sole means of physical support for said resistive incandescent filament.

6. An electric lamp as in claim 4 wherein said inlead wires are coated with a dissimilar metal.

7. An electric lamp as in claim 6 wherein said metal coating serves to avoid migration of the inlead material.

8. An electric lamp as in claim 6 wherein the metal coating has higher electrical conductivity than the inlead material.

9. An electric lamp having a transparent envelope containing a pair of conductive inlead wires connected directly to a resistive incandescent filament said resistive incandescent filament being physically aligned with respect to the longitudinal direction of said inlead wires, said inlead wires serving as the sole means of physical support for said resistive incandescent filament, and wherein said inlead wires both comprise carbon steel containing silicon in an amount from slightly more than about 2 weight percent up to about 4.5 weight percent to avoid allotropic transformation to the gamma austenite crystalline phase at lamp operating temperatures.

10. An electric lamp as in claim 9 wherein the end of the inlead wires not connected to the resistive incandescent filament are joined to dumet metal.

* * * * *